US007828060B2

(12) United States Patent
Churchill

(10) Patent No.: US 7,828,060 B2
(45) Date of Patent: Nov. 9, 2010

(54) DRIFTING TUBING

(75) Inventor: Andrew Churchill, Aberdeen (GB)

(73) Assignee: Churchill Drilling Tools Limited, Aberdeen, Scotland (GB)

( * ) Notice: Subject to any disclaimer, the term of this patent is extended or adjusted under 35 U.S.C. 154(b) by 0 days.

(21) Appl. No.: 12/347,514

(22) Filed: Dec. 31, 2008

(65) Prior Publication Data

US 2009/0173495 A1 Jul. 9, 2009

Related U.S. Application Data

(63) Continuation of application No. 10/552,109, filed as application No. PCT/GB2004/001472 on Apr. 2, 2004, now Pat. No. 7,472,749.

(30) Foreign Application Priority Data

Apr. 4, 2003 (GB) ..... 0307766.6
Jul. 14, 2003 (GB) ..... 0316427.4

(51) Int. Cl.
*E21B 47/09* (2006.01)

(52) U.S. Cl. ..... 166/255.1; 166/113

(58) Field of Classification Search ..... 166/255.1, 166/113, 318; 175/317, 237, 320; 73/152.57
See application file for complete search history.

(56) References Cited

U.S. PATENT DOCUMENTS

| | | | |
|---|---|---|---|
| 1,662,429 | A | 3/1928 | Lowy |
| 2,428,326 | A | 9/1947 | Fay |
| 2,558,977 | A | 7/1951 | Pearson |
| 2,590,233 | A | 3/1952 | Condra |
| 2,868,297 | A | 1/1959 | Lamberson, Jr. |
| 3,279,543 | A | 10/1966 | Yetman |
| 3,523,580 | A | 8/1970 | Lebourg |
| 3,965,978 | A | 6/1976 | Conley et al. |
| 3,997,003 | A | 12/1976 | Adkins |
| 4,108,257 | A | 8/1978 | Sizer |
| 4,452,306 | A | 6/1984 | Polley |
| 4,819,726 | A | 4/1989 | Beirute et al. |
| 5,343,946 | A | 9/1994 | Morrill |
| 5,351,758 | A | 10/1994 | Henderson et al. |
| 5,934,389 | A | 8/1999 | Ramsey et al. |
| 6,581,453 | B1 | 6/2003 | Bjørnstad |

FOREIGN PATENT DOCUMENTS

| | | |
|---|---|---|
| GB | 2044823 | 10/1980 |
| GB | 2347956 | 9/2000 |
| GB | 2377953 | 1/2003 |
| WO | WO-9936659 | 7/1999 |

*Primary Examiner*—Kenneth Thompson
(74) *Attorney, Agent, or Firm*—Gifford, Krass, Sprinkle, Anderson & Citkowski, P.C.

(57) ABSTRACT

A method of checking for restrictions in a string of tubing formed of a plurality of tubing sections. The method involves providing a profile in the tubing string, providing a drift member adapted to engage with the profile, passing the drift member through the tubing string, and determining whether the drift member has engaged with the profile prior to separating the tubing sections.

48 Claims, 7 Drawing Sheets

DRIFTING TUBING

CROSS-REFERENCE TO RELATED APPLICATIONS

This application is a continuation of application Ser. No. 10/552,109 filed on Oct. 4, 2005, now U.S. Pat. No. 7,472,749, which is a 371 of PCT/GB2004/001472 filed Apr. 2, 2004, which claims priority to GB 0307766.6 filed Apr. 4, 2003, and GB 0316427.4 filed Jul. 14, 2003.

FIELD OF THE INVENTION

This invention relates to drifting tubing; that is, the process of determining whether the bore of a length of tubing is restricted or obstructed.

BACKGROUND OF THE INVENTION

In the oil and gas exploration and production industry long strings of jointed tubing or pipe are utilised to carry fluids between the surface and downhole locations within drilled bores, which strings and bores may be several kilometers long. In all downhole operations there is a small possibility of the pipe bore becoming restricted by, for example, cement residue or foreign objects such as a piece of wood or a metal bolt. In most cases this does not have any detrimental effect on operations. However, there are numerous tools and procedures that require a ball, dart or plug to travel through the pipe to perform a specific function downhole. Accordingly, prior to such operations it is necessary to inspect the pipe for the presence of any restrictions which would hold up the ball, dart or plug. Such inspections are normally achieved by checking the pipe string in stages as the string is pulled out of the bore and the pipe sections are separated at surface, before being reassembled in preparation for the operation involving the passage of the ball, dart or plug. Pipe strings are normally formed of large numbers of pipe sections that are typically around 10 meters long and have threaded ends. The pipe sections are often made up and stored as "stands", each formed of three pipe sections, and thus around 30 meters long. Accordingly, when a pipe string is being pulled out of a bore, the string is lifted in 30 meter stages, to allow the uppermost stand to be removed.

One other commonly used method of checking the pipe bore for restrictions is to drop a hollow sleeve, of a slightly larger diameter than the ball, sleeve or plug, on a 40 m length of wire into the upper end of the pipe string. The pipe string is then pulled out of the bore to allow removal of the top pipe stand. If the wire is visible when the stand is separated from the string the operator knows that the sleeve is in the next stand and that the stand that has been separated from the string is unobstructed. This operation may be carried out relatively rapidly, but on many occasions the sleeve will not drop through the pipe, and the wire may become tangled or drop down such that it is not visible when the stand is separated. Thus, the drift and the obstruction point may go unnoticed.

In another method, an operator working at an elevated level simply drops an object, or drift, of a slightly larger diameter than the ball, sleeve or plug, through each pipe stand as it is being racked. The drift is retrieved at the bottom of the stand and then returned to the operator by means of the elevators used to lift the pipe out of the bore. This process is relatively slow, and it is not unknown for the drift to be dropped or otherwise fall, at significant risk to operators working below.

Bjørnstad U.S. Pat. No. 6,581,453 teaches a method of drifting pipe where the drift includes a radio transmitter or radioactive source. The drift is used in conjunction with a detection device positioned at surface to locate the position of the drift inside the drillpipe as the pipe is pulled from the hole. Such electronic detection of a drift has the drawback of being somewhat complicated, and the equipment would require to be physically robust. The equipment would also have to be intrinsically safe so as not to provide an ignition source. If the drift incorporated a radioactive source, regulations would require the drift to be handled and stored with great care. Bjørnstad also teaches a 30 m long drift in the form of a pipe that will be detected by default as the pipe is pulled from the hole. However, it is believed that the considerable weight of the drift and other issues would pose significant practical difficulties for an operator.

Polley U.S. Pat. No. 4,452,306 describes apparatus for detecting ruptures in drill pipe above and below the drill collar. The apparatus is deployed in response to surface loss in drilling pressure, indicative of washout in the drill pipe. The apparatus comprises a tool that may be pumped down through a drill pipe string to seat in a sub in the drill string above the drill collars. The drill pipe string is then pressurised above the tool to a predetermined pressure and the pressure held for a predetermined time. The pressure is monitored and, if the pressure holds, any rupture in the drill pipe is below the tool. If the pressure holds, the pressure in the string above the tool is increased to shear pins in the tool, allowing an actuator within the tool body to move and expose by-pass apertures. This allows fluid to drain from string as the string is retrieved to permit drill pipe repair below the drill collars. If, on the other hand, the drill pipe does not hold pressure above the tool, the drill pipe is pulled one section at a time. The stands are checked until the drill pipe washout is located. The damaged pipe is replaced and the drill string is tested again. If the pressure holds, the pressure is increased until the pins shear, to allow circulation through the tool. The tool may then be retrieved on wireline.

Morrill U.S. Pat. No. 5,343,946 describes a drop-in check valve used to re-establish control of a well in circumstances where there may be a gas build-up downhole. The valve is pumped from surface to lock into a landing sub provided in the string close to the bottom of the hole. The valve includes a ball that is pushed against a seat when the downhole pressure exceeds the pressure above the valve.

It is among the objectives of embodiments of the present invention to provide an efficient, technically simple and safe method for drifting tubing.

BRIEF SUMMARY OF THE INVENTION

According to the present invention there is provided a method of checking for restrictions in a string of tubing comprising a plurality of tubing sections, the method comprising:

providing a profile in the tubing string;

providing a drift member adapted to engage with said profile;

passing the drift member through the tubing string; and determining whether the drift member has engaged with said profile prior to separating the tubing sections.

The invention also relates to apparatus for identifying the presence of a bore restriction in a tubing string, the apparatus comprising a drift member adapted to pass through tubing and to engage a profile in the tubing bore, the engagement of the drift member with the profile being operator detectable.

The tubing may be located in a hole or bore, and will typically take the form of a tubing or pipe string. If the tubing profile is located towards the distal end of the tubing, the passage of the drift member through the tubing to engage the profile identifies to the operator that the tubing does not contain any restrictions which would prevent passage of the member, such that the tubing string may then be retrieved without having to carry out any further checks for the presence of restrictions. In other embodiments it may be desired to run a ball, dart or plug through the tubing without first retrieving the tubing string, and the passage of the drift member through the tubing to engage the profile identifies to the operator that the ball, dart or plug will be free to pass through the tubing to its intended location. In this case, the drift member is preferably retrievable, and to this end may be provided with a fishing neck of the like. Of course if the drift member fails to engage the profile this indicates to the operator that the ball, dart or plug would be unable to pass through the tubing and the tubing must then be cleared or retrieved for inspection.

The method may further include the step of identifying the diameter of a ball, dart, plug or other device to be passed through the tubing and selecting a drift member of similar diameter; typically, a drift member will be selected which defines a diameter or dimension only slightly larger than the device. Thus, in some cases, the drift member will not identify minor restrictions in a length of tubing, which would not affect the passage of the device. This avoids unnecessary inspection of tubing for restrictions, which would not impact on the passage of the device.

Preferably, the drift member is adapted to be pumped through the tubing. The member may thus travel relatively quickly and positively through the tubing, and will not be reliant solely on gravity to pass through the tubing, reducing the likelihood of the member stopping in the tubing other than when the member encounters a substantial restriction. The drift member may incorporate fins, which may be flexible, to facilitate in translating the member through the tubing, or the member may be otherwise configured to assist in moving the member reliably through the tubing.

Preferably, the drift member is adapted to permit fluid flow therethrough, for example the member may be in the form of a sleeve. Thus, even with the drift member engaged with the profile, or engaged with a restriction, fluid may pass through the member. This permits fluid to drain from the tubing through the member and, if necessary, for fluid to be passed through the tubing. In certain embodiments, the drift member may have a configuration adapted to prevent or significantly restrict fluid flow: the member may incorporate a burst disc or the like which initially serves to occlude the tubing, but which may be removed or otherwise opened. One advantage offered by such an arrangement is that, if the drift member encounters a restriction, the location of the restriction may be determined by identifying the volume of fluid that has been pumped into the tubing behind the drift member when the member encounters the restriction. Thus, when the tubing string is being retrieved, it will not be necessary to check for restrictions until reaching the anticipated location of the drift member in the string.

In one embodiment of the invention, a first drift member adapted to permit fluid flow therethrough may be passed through the tubing. Such a drift member may be pumped through the tubing relatively quickly. If no restriction is encountered, the tubing may then be retrieved. However, if the presence of a restriction is identified, a second drift member adapted to prevent or significantly restrict fluid flow is then passed through the tubing, typically at a slower rate than the first drift member. Of course the second drift member will encounter and be stopped in the tubing by the first drift member. The location of the restriction may then be identified, by reference to the volume of fluid pumped into the tubing behind the second drift member, such that only a limited length of the tubing string need be checked for the presence of restrictions.

Preferably, engagement of the drift member with the profile restricts fluid flow through the tubing, which restriction is remotely detectable. Where the tubing extends downhole, engagement of the member with the profile may be identified as a rise in pump pressure at surface.

Preferably, the drift member comprises a sleeve or the like incorporating a flow restriction, such as a nozzle or orifice, adapted to create a fluid pressure differential in fluid passing therethrough. The flow restriction may comprise a hardened or otherwise erosion-resistant material.

It should be noted that any hollow sleeve would produce a restriction upon landing on a restriction or profile. However, in order to be useful in the preferred environment of the present invention the sleeve must create a noticeable pressure increase, and so the restriction must be significant. This may be illustrated by way of example: although pipe size can vary greatly, the most common drill pipe size is 5 inch diameter, which normally comprises sections of pipe each with an internal diameter of 4.25 inch over most of its length and 2.9 inch at the pipe connection. This corresponds to a flow area of 14.2 sq-in and 6.6 sq-in respectively. A typical mud pump has a maximum working pressure of 5000 psi and the pumps normally work at about 4000 psi. The maximum typical flowrate for a drifting situation would be 500 gallons per minute (1900 LPM). At this rate an operator at surface would typically see a 750 psi increase in pressure from a 0.75 in choke (0.44 sq-in), a 235 psi increase from a 1.0 in choke (0.79 sq-in), or a 45 psi increase with a 1.5 in choke (1.76 sq-in). If the operator were only able to pump at half this rate the corresponding pressures increases would be only one quarter, that is 188 psi, 59 psi & 12 psi respectively. It will be clear from this example that if a clear and unambiguous pressure increase is required on a 5000 psi scale pressure gauge to confirm a good drift, the choke must be of a known and significantly smaller internal diameter than the pipe minimum diameter. Thus, a simple hollow sleeve is unlikely to create a pressure increase at surface of sufficient magnitude to be easily and reliably identified.

Preferably, the drift member is adapted to be retrievable from the tubing. The member may incorporate a profile, more particularly a fishing profile, to facilitate withdrawal of the member from the tubing.

The tubing profile may be formed integrally with a portion of the tubing, for example the tubing may incorporate a section or sub that defines the profile. Most preferably, the profile may be defined by a member, such as a ring or sleeve, adapted to be located within a section of tubing, which section of tubing may be adapted to receive the member. Such a profile member may thus be removed and replaced when worn or damaged, or when it is desired to employ a different form of drift member, more particularly a drift member of different dimensions. Alternatively, the profile may be defined by a member adapted for location in conventional tubing, the member preferably adapted for location at a connection between tubing sections, particularly in a female or box connection. The profile member will thus be readily accessible when the tubing is disassembled, and may be located in a tubing string at an appropriate location while the string is being made up. Conveniently, the profile member may be located in a stress relief profiled section of a box connection.

When the drift member engages the profile member, the velocity of the drift member and the momentum of the fluid following behind the drift member are likely to be such that profile member will be struck with considerable force.

Indeed, in one embodiment of the invention it has been estimated that a five tone force is exerted on the profile member when the drift member lands on the profile. In such circumstances the profile member may be forced into tight engagement with the tubing and thus subsequent removal of the profile member from the tubing may be difficult. To this end, the profile member may include a profile or the like adapted to engage a tool or device to facilitate removal of the profile member from the tubing.

The profile member may be adapted to form a seal with the tubing.

The drift member may define a profile adapted to engage with the tubing profile. Preferably, the drift member comprises a body and the profile is removably mounted thereon. Thus, a drift member may be readily modified to define a different diameter by replacing the drift profile. Also, a worn or damaged drift profile may be readily replaced.

The drift member may be adapted to form a seal with the profile, such that any fluid flowing through the tubing when the drift member is engaged in the profile must flow through the drift member. This will ensure the presence of a predictable or predetermined pressure drop when the drift member is correctly located in the profile, facilitating differentiation from occasions when the drift member encounters and is restrained by a restriction in the tubing before reaching the profile.

In one embodiment, the drift member may define one or more flow ports spaced from the leading end of the member. For example, where the drift member comprises a sleeve, the one or more ports may be provided in the sleeve wall. Thus, if the leading end of the sleeve encounters and engages a restriction fluid may flow through the annulus between the trailing end of the sleeve and the tubing, through the flow ports and into the interior of the sleeve, and then through the leading end of the sleeve. This minimises the likelihood of the drift member engaging with an obstruction being mistaken for the drift member engaging the profile. In a preferred embodiment, the drift member comprises a sleeve having an external profile and defining an internal flow restriction. In such an apparatus, the flow ports may be located in the sleeve wall forwardly of the internal flow restriction and the profile.

According to another aspect of the present invention there is provided a method of checking for restrictions in a length of tubing, the method comprising:

passing a drift member through the tubing; and identifying the location of the drift member in the tubing.

The location of the drift member may be identified remotely, as described above; that is, by utilising a drift member adapted to prevent or significantly reduce fluid flow through the tubing. If the drift member encounters a restriction, the location of the restriction may be identified by determining the volume of fluid that has been pumped into the tubing behind the drift member. Preferably, this drift would have a rupture disc, or other means to allow the fluid to drain while pulling the pipe after the position of the obstruction has been located.

Alternatively, the drift member may be simply and practically adapted to be readily detectable to an operator as the tubing is retrieved, or alternatively by an appropriate sensor. Thus, the tubing may be retrieved without the requirement to check for restrictions or obstructions until the presence of the drift member is detected, at which point the obstruction can be removed or the section of pipe with the obstruction can be removed from the string. In one embodiment this may be achieved by attaching a tail to the drift member, preferably a stiff tail, the tail most preferably being made up of shorter, smaller diameter interconnected sections of flexible rod or pipe that can be easily handled. Preferably, the tail would be of relatively lightweight material to facilitate handling of the assembled apparatus and to avoid or minimise damage as the apparatus member travels through the tubing. Alternatively, the drift member could be fitted with an audible signalling device, such as a bell provided with a hydrostatic control switch. The signalling device could be battery powered or most preferably clockwork, such that when the drift member came to surface, where there is no hydrostatic pressure, the bell sounds, alerting personnel to the presence of the drift member in the pipe.

In certain embodiments the drift member may comprise a radioactive source, detectable by means of a Geiger counter or the like. Alternatively, the drift member may comprise a radio transmitter, the signals from the transmitter being detected by an appropriate receiver. In other embodiments, the drift member may include means for producing an electromagnetic or electrical output, or simply a magnetic member, or indeed any form of output or signal that is detectable externally of the tubing. However, as these embodiments require the provision of dedicated detection apparatus, with the associated cost and potential inconvenience, it is anticipated that operators will prefer solutions such as the bell described above.

In other embodiments, the location of the drift member may be identified from surface immediately following landing of the drift member on an obstruction. For example, the tubing or surrounding bore-lining casing may incorporate sensors capable of identifying the drift member location and transmitting the appropriate information to surface.

BRIEF DESCRIPTION OF THE DRAWINGS

These and other aspects of the invention will now be described, by way of example, with reference to the accompanying drawings, in which.

DETAILED DESCRIPTION OF THE INVENTION

Figure 1:
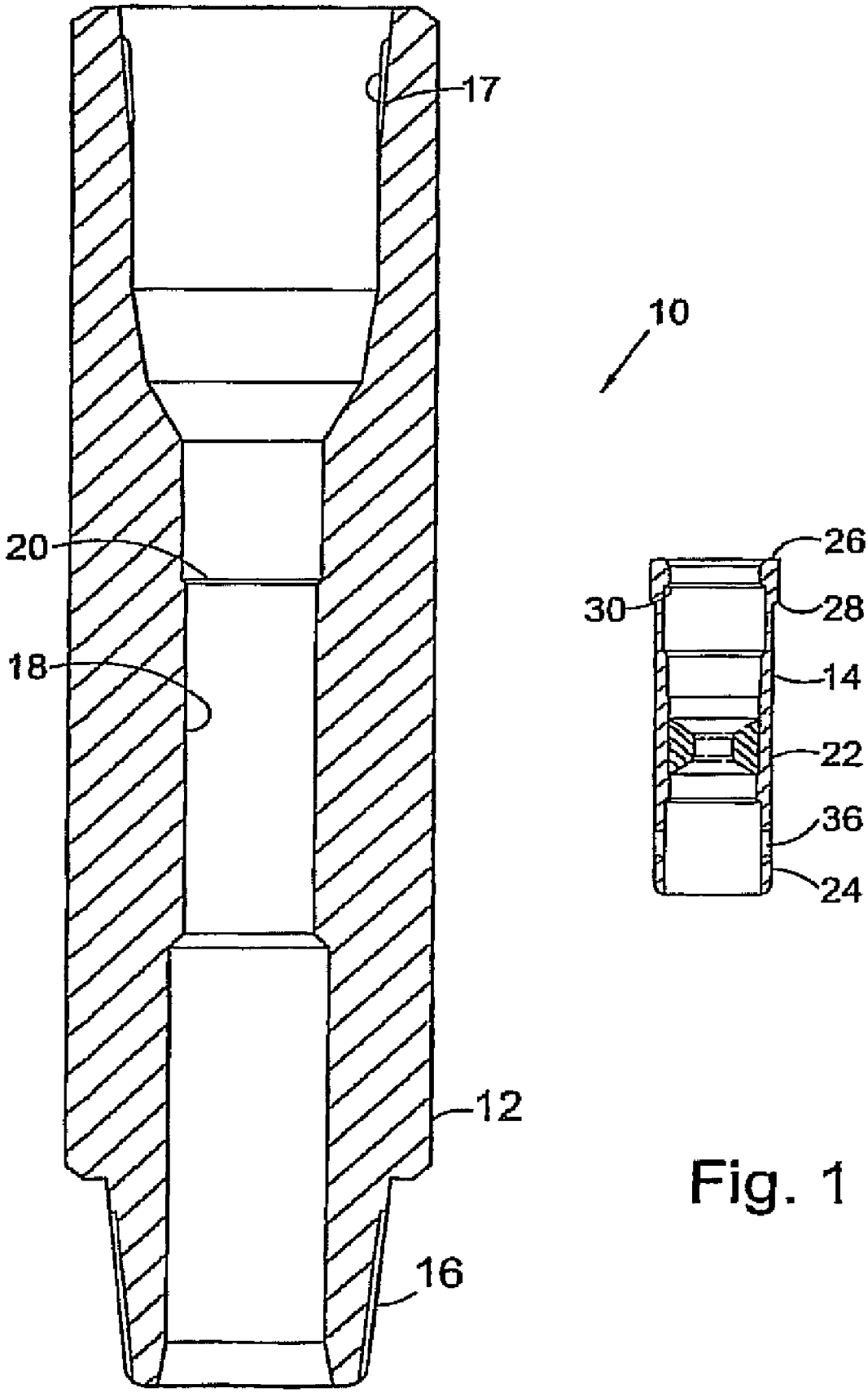
FIG. 1 is a sectional view of apparatus for identifying bore restrictions in tubing, in accordance with an embodiment of the present invention and showing a drift member located externally of a profiled sub.

Reference is first made to FIG. 1 of the drawings, which illustrates apparatus for use in identifying bore restrictions in tubing, in accordance with an embodiment of the present invention. The apparatus 10 comprises a sub 12 and a drift member in the form of a drift sleeve 14 adapted to engage within the sub 12, as will be described.

The sub 12 is intended for incorporation in the lower end of a string of conventional drill pipe, and thus incorporates conventional pin and box connections 16, 17, and defines a central through bore 18. However, the bore 18 defines a profile in the form of a shoulder 20 arranged to receive and engage the drift sleeve 14, which is illustrated externally of the sub 12 in FIG. 1.

Figure 2:
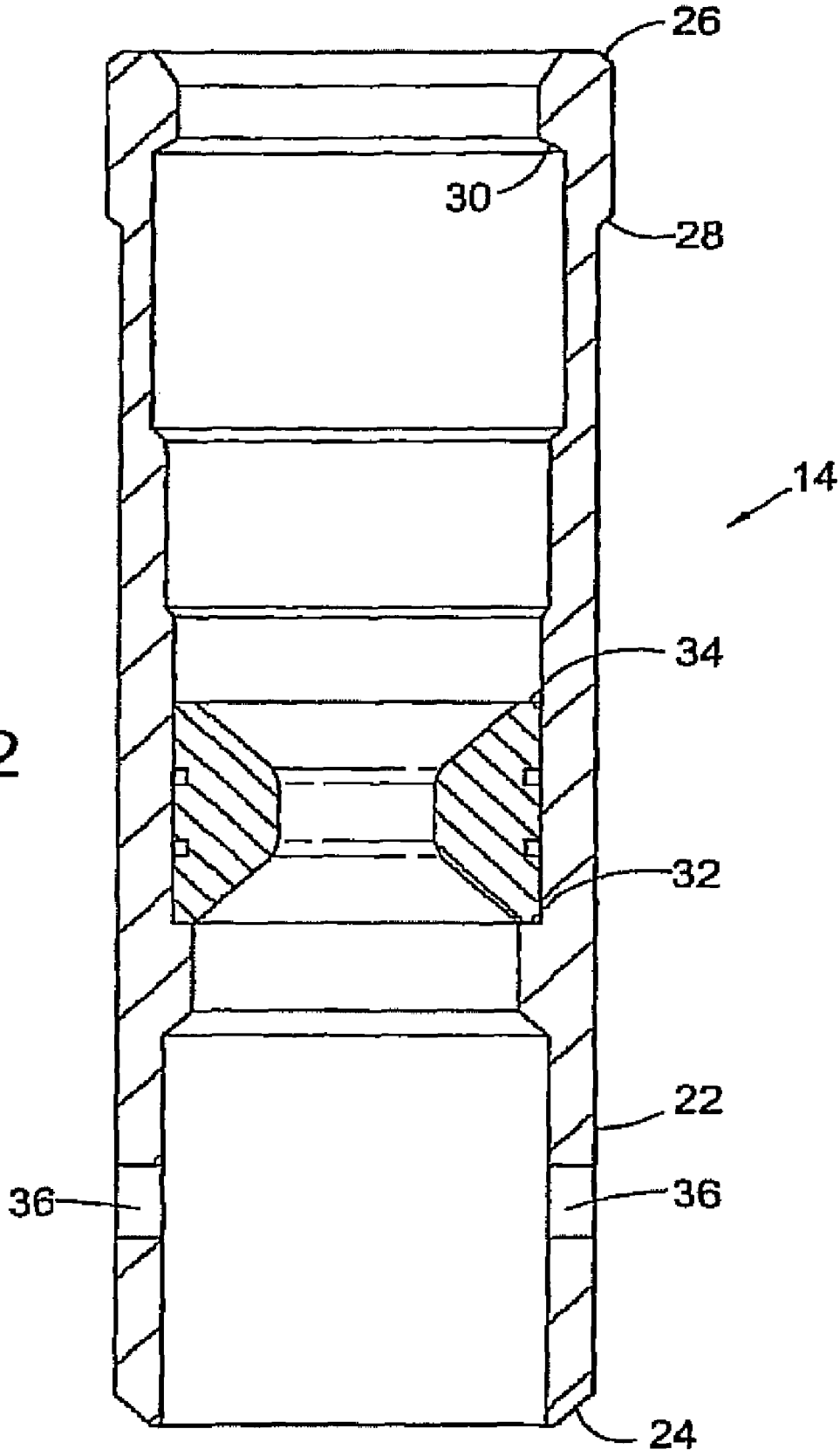
FIG. 2 is an enlarged sectional view of the drift member of FIG. 1.

The drift 14 is illustrated in greater detail in FIG. 2 of the drawings, and comprises a generally cylindrical body 22 with a slightly tapered leading end 24, whereas the trailing end 26 defines an external profile 28 for co-operation with the sub shoulder 20 and an internal fishing profile 30. An internal ledge 32 within the sleeve body 22 supports a hardened nozzle ring 34 that is in sealing engagement with the inner wall of the sleeve body 22.

Radial flow ports 36 are provided in the body 22, between the leading end 24 and the nozzle ring 34.

In use, as a pipe string is made up and lowered into a drilled bore, the sub 12 is incorporated in the string, at or towards the leading or distal end of the string. Once the operation requiring use of the string have been completed, and before the string is pulled out of the bore and disassembled, the drift sleeve 14 is inserted into the string bore at surface and pumped down through the string. If the string bore is substantially free from obstruction or restriction, the sleeve 14 will pass down through the string until it encounters the drift sub 12, where the sleeve profile 28 will engage the sub shoulder 20 and prevent further travel of the sleeve 14. The sub bore 18 and the sleeve external configuration are such that the sleeve 14 is substantially a sealing fit within the sub 12, such that any fluid passing through the string from surface must then pass through the nozzle 34, and will therefore experience a pressure drop. The restriction introduced into the string bore by the nozzle 34 is reflected at surface by a readily identifiable increase in pump pressure, which indicates to the operators on surface that the sleeve 14 has engaged within the sub 12, and that the pipe string is substantially free of obstruction and restriction.

However, where the pipe string has been restricted or obstructed by, for example, cement residue, the sleeve 14 will not be able to pass the restriction to reach and engage with the sub 12. In such circumstances, the sleeve 14 will of course still create a flow restriction in the pipe string bore, however the leading end 24 will land on the restriction in the pipe but the sleeve 14 will not sealingly engage with the pipe such that fluid will flow around as well as through the sleeve 14. If the leading end 24 should encounter an annular pipe restriction, preventing flow between the exterior of the leading end 24 and the pipe wall, fluid may still pass through the flow ports 36. Thus, while the engagement of the sleeve 14 with a restriction may be reflected in an increase in pump pressure at surface, this increase will be noticeably less than the pressure increase that would be expected if the sleeve 14 were to engage and locate within the drift sub 12. Accordingly, the operators are then alerted to the fact that the string bore is restricted or obstructed. In this case, which it is expected will occur in perhaps one in ten runs of a drift sleeve 14, the pipe string can be checked for obstructions on a stand-by-stand basis, in a conventional manner, as described above. Alternatively, the sleeve 14 may be used in conjunction with a further drift sub as will be described subsequently, with reference to FIGS. 4 and 5.

Of course, in the perhaps nine out of ten cases in which the drift sleeve 14 passes through the string to engage within the drift sub 12, it is not necessary for the operator to check the string bore as the string is disassembled on surface, providing a significant saving in time and thus expense.

Figure 3:
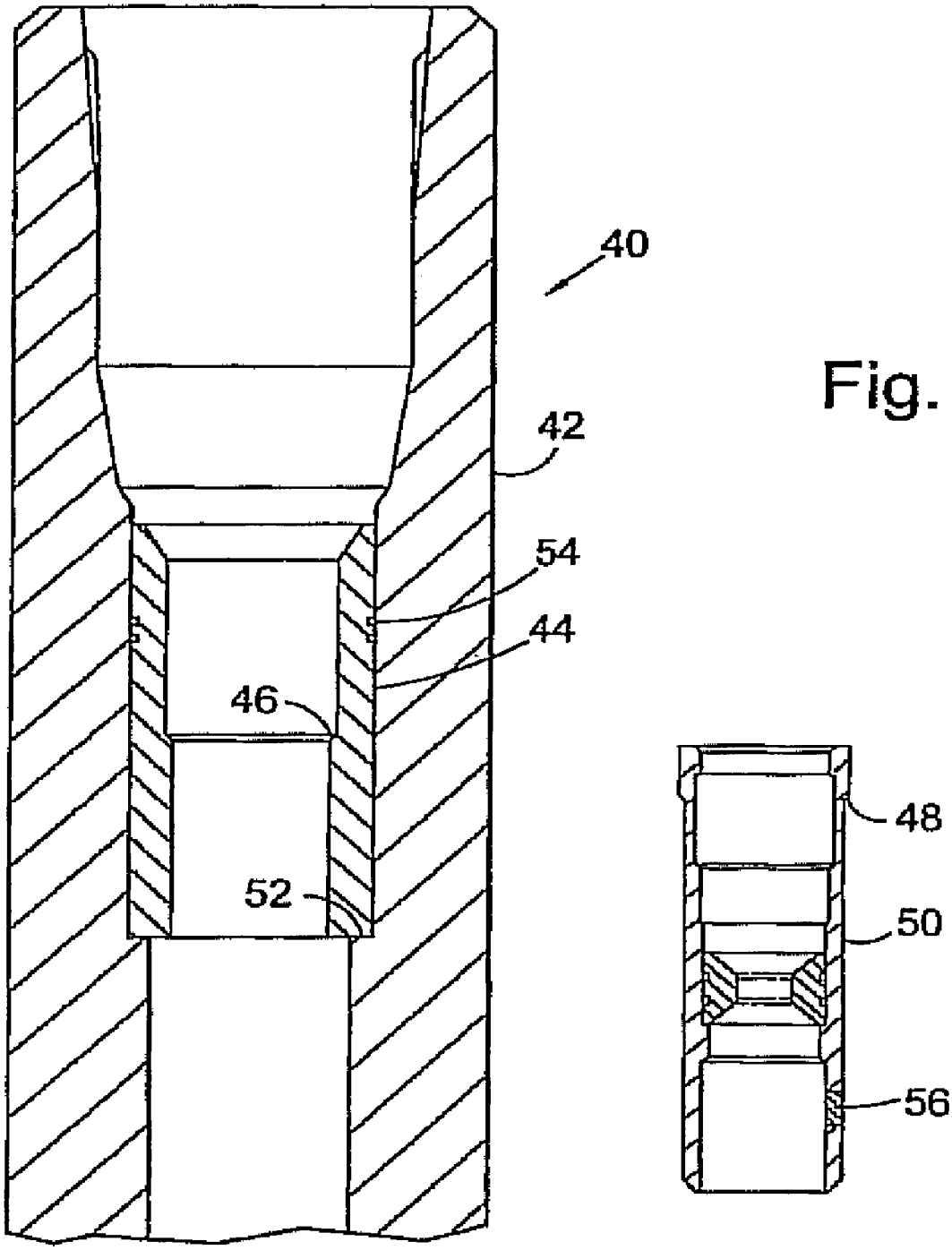
FIG. 3 is a sectional view of apparatus for identifying bore restrictions in tubing, in accordance with a further embodiment of the invention.

Reference is now made to FIG. 3 of the drawings, which illustrates apparatus 40 for use in identifying bore restrictions in tubing, in accordance with a further embodiment of the invention. The apparatus 40 is substantially similar to the apparatus 10 described above, however, rather that incorporating an integral profile or shoulder 20, as in the drift sub 12, the drift sub 42 of this embodiment is provided with an insert 44 that defines an internal profile 46 adapted to engage a corresponding profile 48 on the drift sleeve 50. The insert 44 sits on a ledge 52 defined within the sleeve bore and also carries external seals 54 to ensure that no fluid passes between the sleeve 44 and the sub bore wall.

The provision of an insert 44 allows the profile 46 to be modified to suit different drift sleeve configurations, and of course the insert 44 may be replaced in case of erosion or damage.

Furthermore, the drift sleeve 50 of this embodiment includes an audible signalling device, in particular a clockwork bell 56 provided with a hydrostatic control switch, such that when the drift sleeve 50 comes to surface, where there is no hydrostatic pressure, the bell sounds, alerting personnel to the presence of the drift sleeve 50 in the pipe.

The ringing of the bell 56 will alert the operators to the presence of the sleeve 50 in a stand of pipe, such that the stand may then be checked for the presence of an obstruction. Of course, it will not have been necessary to check any of the preceding stands for the presence of the sleeve 50 and a corresponding string bore restriction or obstruction.

Figure 4:
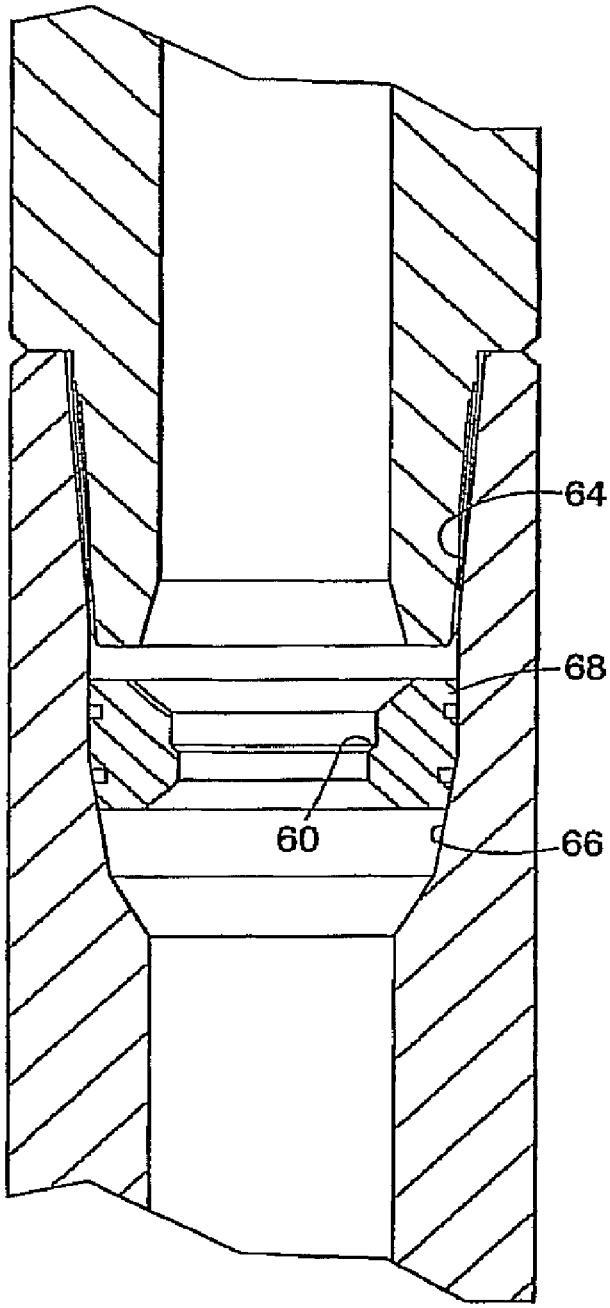
FIG. 4 is a sectional view of apparatus for identifying bore restrictions in tubing in accordance with a still further embodiment of the present invention.
Figure 4:
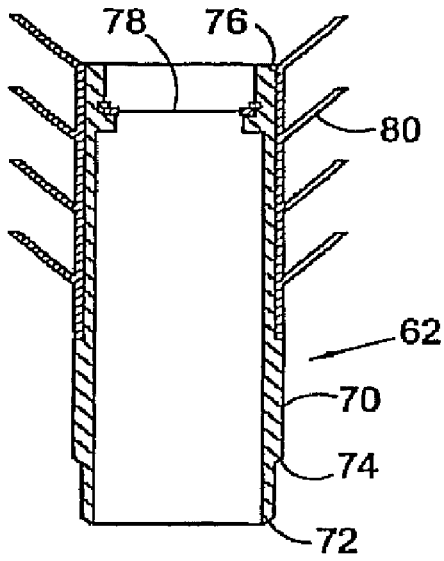
Figure 5:
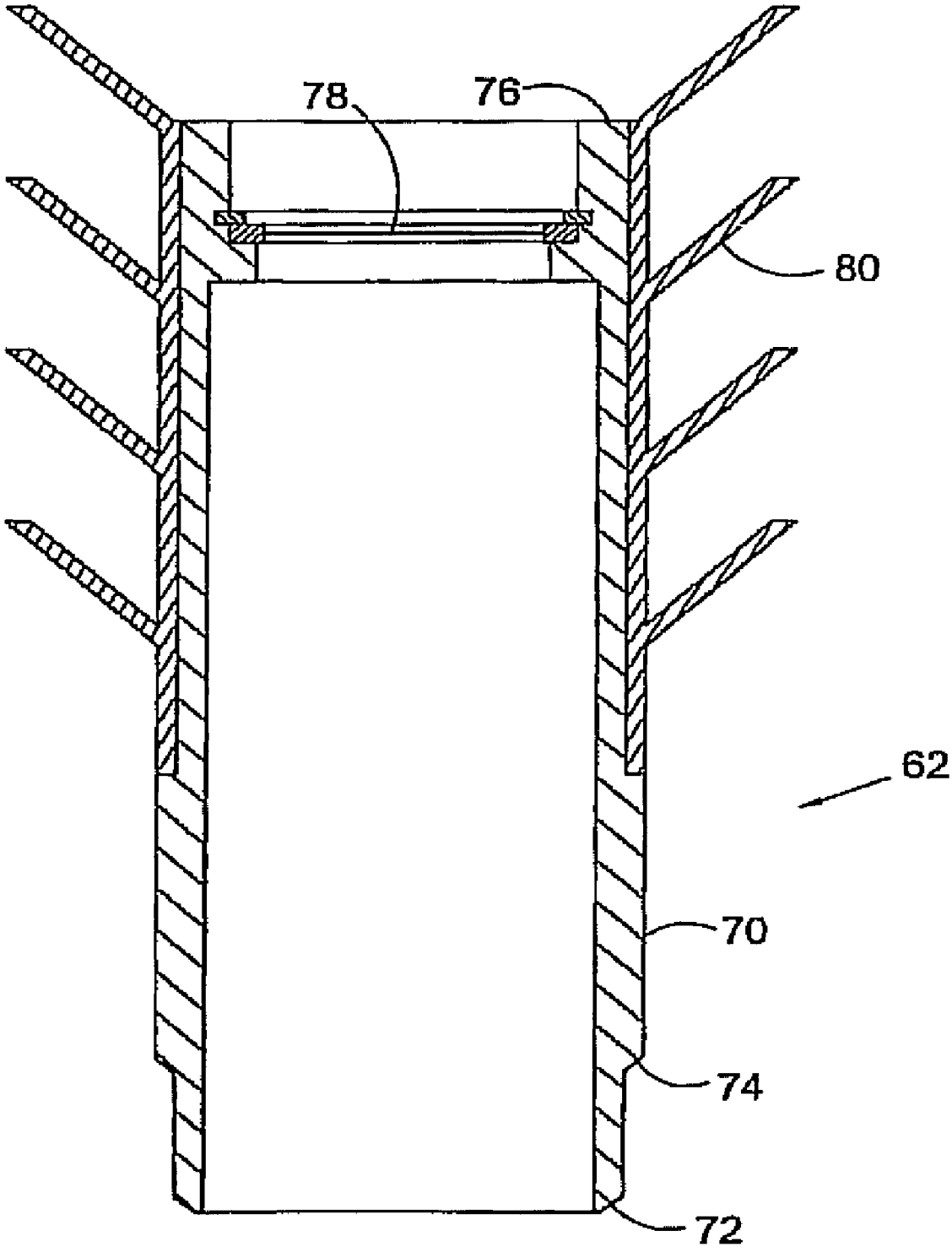
FIG. 5 is an enlarged sectional view of the drift member of FIG. 4.

Reference is now made to FIGS. 4 and 5 of the drawings, which illustrate apparatus for identifying bore restrictions in tubing in accordance with a still further embodiment of the present invention. In this embodiment, there is no requirement to provide a specially adapted drift sub, as the profile 60 for engaging with the drift member, in this example in the form of a cylindrical drift dart 62, is adapted to be located within a conventional pipe section, and in particular within the "bore back" box connection 64 of a pipe section 66. This particular form of box is a common feature on pipe sections, intended to reduce fatigue at the connection.

The profile 60 is defined by a nozzle ring 68 which may be located within the box connection 64 during the make-up of the pipe string, the ring 68 forming a sealing fit with the inner wall of the connection 64.

The drift dart 62 comprises a generally cylindrical body 70 having a tapering leading end 72 and defining an external profile 74 adjacent the leading end 72, for engaging with the profile 60. The trailing end 76 incorporates a burst disc 78 and features external flexible fins 80 that assist in stabilising the dart 62 as it is pumped through the tubing string.

In use, the dart 62 is inserted into the tubing string bore at surface and is then pumped down through the string. If there are no significant bore restrictions or obstructions the dart 62 will pass through the string until it engages with the profile 60. This will be reflected by a sharp increase in pump pressure at the surface, which will be readily detectable by the operators. By identifying the volume of fluid that has been pumped into the string bore behind the dart 62, it is possible to confirm that the dart has reached the profile 60, as the location of the profile 60 is known. By increasing the pump pressure further the operators may burst the disc 78, such that fluid may drain from the tubing string as it is withdrawn and dismantled.

If, on the other hand, the dart 62 encounters a restriction or obstruction before reaching the profile 60, there will be a similar increase in pump pressure at surface. However, as the dart 62 has not traveled as far as it would in the absence of the restriction or obstruction, the volume of fluid pumped into the string bore will be less than that which would be expected were the dart 62 to pass all the way through the pipe string and engage with the profile 60. Accordingly, the operators will be alerted to the fact that there is a restriction or an obstruction in the string bore. Furthermore, the volume of fluid pumped into the bore will provide an indication of the location of the obstruction in the string such that the bore need not be checked as the string is pulled out of the bore until approaching the anticipated location of the dart 62 in the string.

This embodiment thus offers the advantage, over the embodiment of FIGS. 1 and 2, of providing an indication of the location of the obstruction and thus reducing the number of pipe stands that need to be checked for obstructions at surface. However, to prevent bursting the disc 78 immediately on encountering a restriction, or the profile 60, the dart 62 must be pumped into the string relatively slowly, and thus may take significantly longer to travel through the string. Accordingly, in some situations, operators may choose to check for restrictions in a pipe string by first pumping down a drift sleeve 14, as illustrated in FIG. 2, which operation may be carried out relatively rapidly. If the sleeve 14 passes all the way through the string to engage with a drift sub 12, no further action is necessary, and the string may be retrieved and dismantled. However, if an obstruction is identified (which is the case in perhaps 5-10% of cases), the drift dart 62 is then pumped into the pipe string. The drift dart 62 will pass down through the string until it encounters the drift sleeve 14, and by noting the volume of fluid pumped down behind the dart 62, the location of the dart in the string, and thus the location of the restriction, may be determined.

Running the drift sleeve 14 is a relatively rapid means for determining the presence of a string bore restriction or obstruction, and in those cases where an obstruction is identified, running the drift dart 62 allows the location of the obstruction to be determined. The additional time involved in running the drift dart 62 is more than compensated for by the saving in time made when retrieving and disassembling the string: the pipe stands need not be checked for the presence of obstructions until the section of the string in which the drift members 14, 62 are located is brought to surface.

Figure 6A:
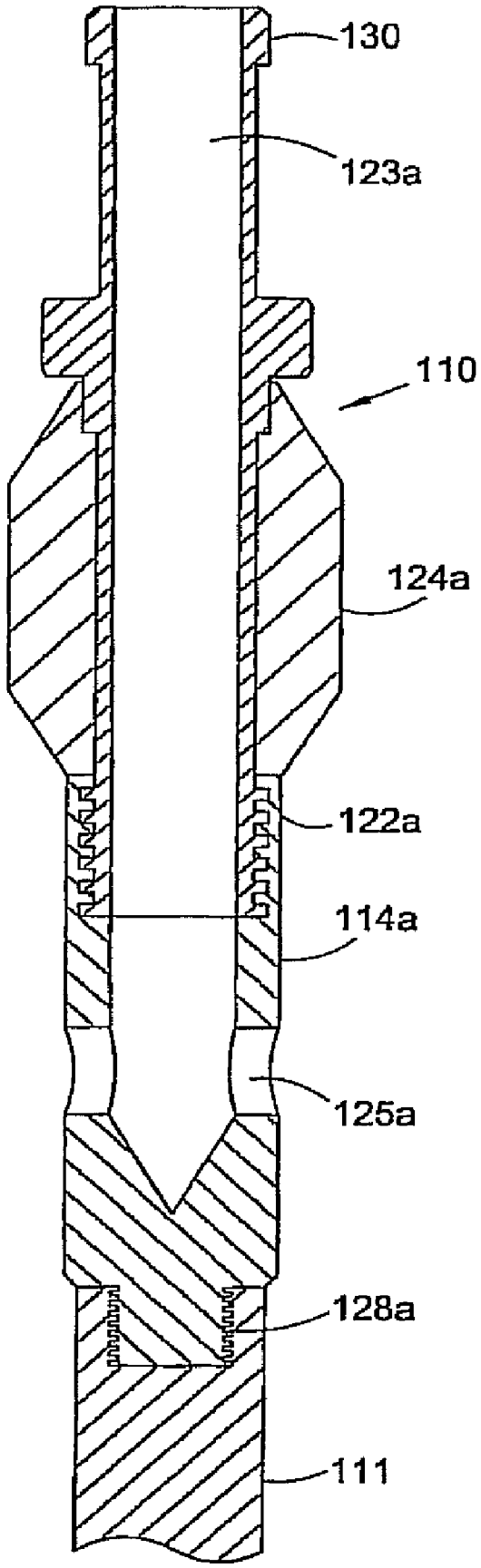
FIGS. 6*a* and 6*b* are sectional views of apparatus for identifying bore restrictions in accordance with a yet further embodiment of the present invention.
Figure 6B:
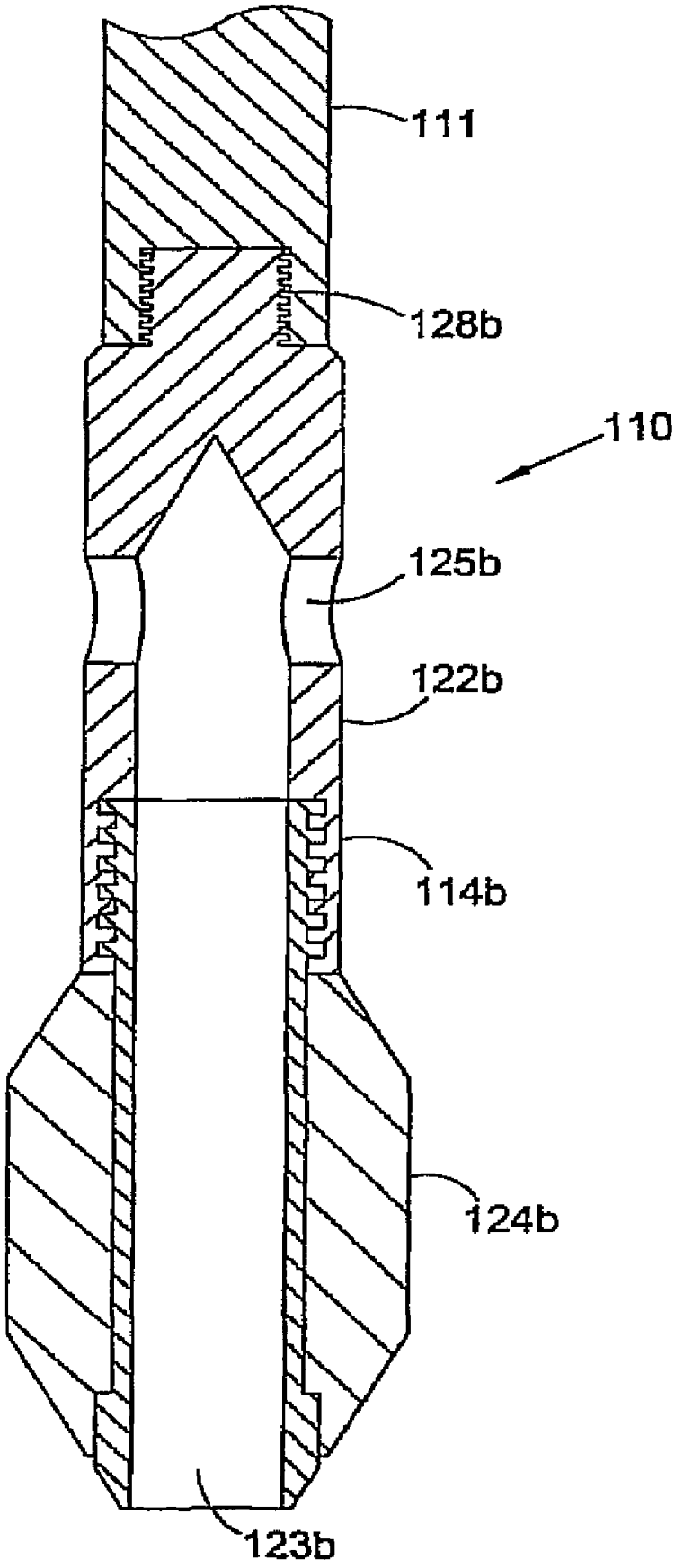

Reference is now made to FIGS. 6*a* and 6*b* of the drawings, which are sectional views of apparatus 110 for identifying bore restrictions in accordance with a yet further embodiment of the present invention. The apparatus 110 comprises a drift member in the form of an elongate drift rod 111 having a stabilising sleeve 114*b* at its leading end and a drift sleeve 114*a* at its trailing end.

The drift sleeve 114*a* comprises a generally cylindrical two-part body 122*a* carrying a replaceable drift profile 124*a*. The upper free end of the drift sleeve 114*a* defines a fishing neck 130, to facilitate retrieval of the apparatus 110, if required. The sleeve leading end defines a threaded male profile 128*a* for co-operation with the upper end of the drift rod 111. The body 122*a* has an open upper end leading into a bore 123*a* which permits the flow of fluid through the body 122*a*, the fluid entering or exiting the lower end of the bore 123*a* via two radial flow ports 125*a*.

The drift rod is formed of a number of composite rod sections. The rod sections are of a length and weight selected to facilitate handling and are joined together to provide a rod 111 approximately 100 feet long. The rod sections may be formed of any appropriate material, such as a polymeric material, a composite or a lightweight metal alloy, and define a smaller diameter than the drift and stabilising sleeves 114*a*, *b*. The rod sections are sufficiently stiff such that the sections are self-supporting but do permit a degree of flex, thus facilitating handling and passage of the apparatus through a string.

The leading, stabilising sleeve 114*b* is of generally similar construction to the drift sleeve 114*a* and comprises a generally cylindrical two-part body 122*b* carrying a replaceable tapered centralising/stabilising profile 124*b*, defining a slightly smaller diameter than the drift profile 124*a*, the sleeve trailing end defining a threaded male profile 128*b* for co-operation with the lower end of the drift rod 111. The body 122*b* has an open leading end and a bore 123*b* communicating with two radial flow entry ports 125*b*.

In other embodiments, different forms of stabilising or centralising arrangement may be utilised, for example a bow-spring type centraliser.

In use, the diameter to which the string should be drifted will have previously been identified; this may be the diameter of a ball, dart or plug it is intended to pass through the string after the string has been retrieved and then run into the bore once more. The diameters of the profiles 124*a*, 124*b* are selected to match this diameter, the trailing drift profile 124*a* typically being selected to be slightly larger than the ball, dart or plug diameter, and the leading stabilising profile 124*b* being slightly smaller (although in some embodiments the diameter of the leading profile may be the greater). The pipe string will also incorporate an appropriately dimensioned a sub 12, 42 or profile 60. The sleeves 114*a*, 114*b* are then assembled and made up to the ends of the drift rod 111, which has been formed by joining the rod sections together. The assembled drift member is inserted into the string bore at surface and pumped down through the string, typically just before retrieval of the string commences.

If the string bore is substantially free from obstruction or restriction, the member will pass down through the string until the drift sleeve 114*a* engages a sub 12, 42 or profile 60, as described above. The landing of the sleeve 114*a* on the sub or profile is identified from the rise in pump pressure at surface. However, where the pipe string has been restricted or obstructed by, for example, cement residue, the sleeve 114*a* will not be able to pass the restriction. As noted above, this may result in a rise in pump pressure at surface, but the rise will be significantly less than that produced by the sleeve 114*a* landing on a sub 12, 42 or profile 60. If necessary, the apparatus 110 may be retrieved from the pipe string by running an appropriate tool into the string to engage with the fishing neck 130, the sleeve 114*a* ensuring that the neck 130 is centralised in the pipe.

As noted above, where the pipe string has been restricted or obstructed the location of the obstruction can be identified without difficulty as the string is retrieved and disassembled on a stand-by-stand basis; the drift rod 111 is longer than a stand of pipe and thus will extend from the end of the stand in which the drift sleeve 114*a* has landed.

The apparatus 110 may be withdrawn from the obstructed stand of pipe and the stand put to one side for inspection. The apparatus 110 is then dropped into the remainder of the string still to be retrieved, to check for the presence of any further restrictions or obstructions.

The apparatus may also be used in circumstances where a sub 12, 42 or profile 60 has not been provided in the pipe string. In these circumstances the apparatus 110, provided with profiles of appropriate diameter 124*a*, 124*b*, may simply be dropped into the string, rather than pumped through the string. If the string bore is substantially free from obstruction or restriction, the member will pass down through the string until the stabilising sleeve 114*b* encounters the upper end of the bottom hole assembly (BHA) or some other pre-existing restriction. The relatively light weight of the apparatus 110 is such that the apparatus will not cause any damage to the string as it passes therethrough, and will not damage the BHA when the member lands on an upper part of the BHA.

However, where the pipe string has been restricted or obstructed by, for example, cement residue, the sleeve 114*a* will not be able to pass the restriction. The operator will not be aware whether the apparatus 110 has passed through the length of the string or has landed on a restriction, however the apparatus 110 will be immediately visible as the string is retrieved and disassembled on a stand-by-stand basis, allowing the presence and location of any restriction to be readily identified.

It will be apparent to those of skill in the art that the above-described embodiments of the present invention provide a relatively rapid means for determining whether there is any significant restriction or obstruction present in a tubing string. The operation may be carried out easily and safely while the tubing string remains in the bore, and the form of the various drift members is such that in the presence of a drift member within a string will not interfere or complicate the subsequent pulling out and disassembly of the string. As noted above, in the great majority of cases where no significant restriction or obstruction is likely to be identified, the operator may then disassemble the string with the knowledge that no restrictions or obstructions are present, and the normal checks for restrictions need not be carried out. Furthermore, a number of embodiments of the present invention allow the location of any restriction or obstruction to be determined, such that only selected portions of the string need be checked for the presence of obstructions.

It will also be apparent to those of skill in the art that the above-described embodiments are merely exemplary of the present invention, and that various modifications and improvements may be made thereto without departing from the scope of the invention.

The invention claimed is:

1. A method of checking for restrictions in a string of tubing located in a hole or bore and comprising a plurality of tubing sections, in preparation for use of the tubing sections in a subsequent operation, the method comprising:

identifying the diameter of a ball, dart, plug or other device to be passed through the tubing in a subsequent operation;

providing a profile in the tubing string;

providing a drift member adapted to engage with said profile;

selecting a drift member diameter at least as great as the diameter of said ball, dart, plug or other device;

passing the drift member through the tubing string to drift the tubing sections;

determining whether the drift member has engaged with said profile, and pulling the tubing string out of hole and separating the tubing sections, further comprising reconnecting drifted tubing sections, running the resulting tubing string back into the hole, and performing the subsequent operation, wherein the subsequent operation includes running said ball, dart or plug through the reconnected tubing sections.

2. The method of claim 1, wherein the profile is located towards a distal end of the tubing.

3. The method of claim 1, further comprising retrieving the drift member prior to separating the tubing sections.

4. The method of claim 1, further comprising separating the tubing sections to locate a restriction therein.

5. The method of claim 1, further comprising pumping the drift member through the tubing.

6. The method of claim 1, further comprising circulating fluid through the tubing containing the drift member.

7. The method of claim 1, further comprising permitting fluid to drain from the tubing through or around the drift member.

8. The method of claim 1, wherein engagement of the drift member with the profile significantly restricts fluid flow through the tubing.

9. The method of claim 1, further comprising reconfiguring the drift member to facilitate fluid flow through the tubing.

10. The method of claim 1, wherein engagement of the drift member with the profile restricts fluid flow through the tubing, and remotely detecting such restriction immediately the drift member engages the profile.

11. The method of claim 10, wherein fluid is pumped through the tubing and engagement of the member with the profile is identified by a rise in pump pressure.

12. The method of claim 11, wherein pump pressure is monitored on a 5000 psi scale pressure gauge.

13. The method of claim 1, comprising providing the tubing profile integrally with a portion of the tubing.

14. The method of claim 1, comprising providing the tubing profile in the form of a member adapted to be located within a section of tubing.

15. The method of claim 14, wherein the tubing profile is located at a connection between tubing sections.

16. Drift apparatus comprising a drift member having an outer diameter configured to be at least as great as the inner diameter of a tubing string and configured to pass through the tubing string comprising a plurality of tubing sections and to engage a profile in the tubing bore, the engagement of the drift member with the profile being operator detectable, and the drift outer diameter configured to provide for assurance of subsequent passage of a ball, dart, plug or other device having an outer diameter less than said outer diameter of the drift member through the tubing sections, wherein the drift member includes a burst disc.

17. The apparatus of claim 16, wherein the drift member is adapted to be pumped through the tubing.

18. The apparatus of claim 16, wherein the drift member has fins.

19. The apparatus of claim 18, wherein the drift member has flexible fins.

20. The apparatus of claim 16, wherein the drift member is adapted to permit fluid flow therethrough.

21. The apparatus of claim 16, wherein the drift member is configurable to prevent or significantly restrict fluid flow therethrough.

22. The apparatus of claim 16, wherein the drift member is adapted such that engagement of the drift member with the profile restricts fluid flow through the tubing, which restriction is remotely detectable.

23. The apparatus of claim 16, wherein the drift member comprises a flow restriction adapted to create a fluid pressure differential in fluid passing therethrough.

24. The apparatus of claim 23, wherein the flow restriction comprises an erosion-resistant material.

25. The apparatus of claim 16, wherein the drift member is adapted to be retrievable from the tubing.

26. The apparatus of claim 25, wherein the drift member comprises a fishing profile.

27. The apparatus of claim 16, further comprising a tubing profile.

28. The apparatus of claim 27, wherein the tubing profile is formed integrally with a portion of tubing.

29. The apparatus of claim 27, wherein the tubing profile is defined by a member adapted to be located within a section of tubing.

30. The apparatus of claim 29, further comprising a section of tubing adapted to receive the tubing profile member.

31. The apparatus of claim 27, wherein the drift member is adapted to form a seal with the tubing profile.

32. The apparatus claim 16, wherein the drift member defines a profile adapted to engage with a tubing profile.

33. The apparatus of claim 32, wherein the drift member comprises a body and the drift profile is removably mounted thereon.

34. The apparatus of claim 16, wherein the drift member is adapted to form a seal with a tubing profile, such that any fluid flowing through the tubing when the drift member is engaged in the profile must flow through the drift member.

35. The apparatus of claim 16, wherein the drift member defines one or more flow ports.

36. The apparatus of claim 35, wherein the one or more flow ports are spaced from the leading end of the member.

37. The apparatus of claim 16, wherein the drift member comprises a sleeve having an external profile and defining an internal flow restriction.

38. Drift apparatus comprising a drift member defining a drift diameter configured to be at least as great as a first diameter and configured to pass through a tubing string comprising a plurality of tubing sections and to engage a profile in the tubing bore, the engagement of the drift member with the profile being operator detectable, and the drift diameter configured to provide for assurance of subsequent passage of a ball, dart, plug or other device of said first diameter through the tubing sections, wherein the drift member defines one or more flow ports; and wherein the drift member comprises a sleeve and the one or more ports are provided in the sleeve wall, whereby if the leading end of the sleeve encounters and engages a restriction fluid may flow through the annulus between the trailing end of the sleeve and the tubing, through the flow ports and into the interior of the sleeve, and then through the leading end of the sleeve.

39. Drift apparatus comprising a drift member defining a drift diameter configured to be at least as great as a first diameter and configured to pass through a tubing string comprising a plurality of tubing sections and to engage a profile in the tubing bore, the engagement of the drift member with the profile being operator detectable, and the drift diameter configured to provide for assurance of subsequent passage of a ball, dart, plug or other device of said first diameter through the tubing sections, wherein the drift member comprises a sleeve having an external profile and defining an internal flow restriction; and wherein one or more ports are provided in a wall of the sleeve, whereby if the leading end of the sleeve encounters and engages a restriction fluid may flow through the annulus between the trailing end of the sleeve and the tubing, through the flow ports and into the interior of the sleeve, and then through the leading end of the sleeve and wherein the flow ports are located in the sleeve wall forwardly of the internal flow restriction and the external profile.

40. A method of checking a string of tubing located in a hole or bore and comprising a plurality of tubing sections, in preparation for the use of the tubing sections in a subsequent operation, the method comprising:

providing a profile in the tubing string;

providing a drift member adapted to engage with said profile;

pumping the drift member through the tubing string to drift the tubing sections;

determining that the drift member has engaged with said profile;

determining the volume of fluid pumped into the tubing behind the drift member when the drift member engages said profile, and pulling the string out of hole and separating the tubing sections.

41. The method of claim 40, further comprising reconnecting drifted tubing sections, running the resulting tubing string back into the hole, and performing the subsequent operation.

42. The method of claim 40, further comprising:

identifying the diameter of a ball, dart, plug or other device to be passed through the tubing in the subsequent operation; and selecting a drift member diameter at least as great as the diameter of said ball, dart, plug or other device.

43. The method of claim 42, further comprising:

reconnecting drifted tubing sections and running the resulting tubing string back into the hole, and running said ball, dart or plug through the resulting tubing string.

44. The method of claim 40, further comprising reconfiguring the drift member to allow the string to drain as the string is pulled out of the hole.

45. Drift apparatus comprising a drift member configured to be pumped through tubing and to engage a profile in the tubing bore, the drift member being configured such that engagement of the drift member with the profile is operator detectable, the drift member having a body defining a drift diameter and fins defining a diameter larger than said drift diameter, wherein the fins are configured to form a seal with the interior of tubing which varies in internal diameter as the drift member is pumped through the tubing, whereby the volume of fluid pumped behind the drift member can be determined.

46. The apparatus of claim 45, wherein the drift member is reconfigurable to permit fluid to drain from the tubing.

47. The apparatus of claim 45, wherein the drift member defines a drift diameter configured to be at least as great as a first diameter and configured to provide for assurance of subsequent passage of a ball, dart, plug or other device of said first diameter through tubing sections which form the tubing.

48. Drift apparatus comprising a drift member configured to be pumped through tubing and to engage a profile in the tubing bore, the drift member being configured such that engagement of the drift member with the profile is operator detectable, the drift member having a body defining a drift diameter and fins defining a diameter larger than said drift diameter, wherein the drift member includes a burst disc.

* * * * *